United States Patent [19]

Hagiwara

[11] Patent Number: 4,697,383

[45] Date of Patent: Oct. 6, 1987

[54] CONTROLLING DEVICE FOR AN AUTOMATIC DOOR

[75] Inventor: Isao Hagiwara, Namerikawa, Japan

[73] Assignee: Yoshida Kogyo K. K., Tokyo, Japan

[21] Appl. No.: 873,357

[22] Filed: Jun. 12, 1986

[30] Foreign Application Priority Data

Jun. 12, 1985 [JP] Japan ..... 60-126347

[51] Int. Cl.[4] ..... E05F 15/20

[52] U.S. Cl. ..... 49/25; 49/31

[58] Field of Search ..... 49/25, 26, 28, 31, 264, 49/265

[56] References Cited

U.S. PATENT DOCUMENTS 4,577,437 3/1986 Gionet et al. ..... 49/25

FOREIGN PATENT DOCUMENTS 3202784 8/1983 Fed. Rep. of Germany ..... 49/25

*Primary Examiner*—Kenneth Downey

*Attorney, Agent, or Firm*—Hill, Van Santen, Steadman & Simpson

[57] ABSTRACT

A controlling device for an automatic door which can detect a human body approaching the door assuredly in a relatively early stage and hence can assure smooth passage thereof by a person after another person has passed it. The controlling device comprises a controller, a first human body detecting sensor having a small detecting area near the door, and a second human body detecting sensor having a wider detecting area which extends remotely from the door and covers the detecting area of the first human body sensor. The controller develops a door opening signal in response to a human body detection signal received from the first human body detecting sensor when a door closing signal is not being developed from the controller whereas it develops a door opening signal in response to a human body detection signal from the second human body detecting sensor when a door closing signal is being developed from the controller. Thus, when the door is being closed, an opening signal is developed at an early stage, but normally an opening signal is developed at a later stage.

2 Claims, 6 Drawing Figures

CONTROLLING DEVICE FOR AN AUTOMATIC DOOR

BACKGROUND OF THE INVENTION

1. Field of the Invention

This invention relates to a controlling device for automatically opening and closing a door of an automatic door system.

2. Description of the Prior Art

A controlling device for an automatic door is already known which comprises a human body detecting sensor such as a mat switch, and a controller responsive to a human body detection signal from the human body detecting sensor for developing forward and reverse rotation signals to a door driving motor, whereby a door is opened in response to a human body detection signal and is then closed after lapse of a predetermined period of time.

Such a human body detecting sensor develops a human body detection signal when a person comes within a predetermined detection area thereof. Thus, if a person comes within the detection area while the door is being closed, a human body detection signal is delivered to the controller so that rotation of the motor is reversed to open the door, that is, a turnover operation of the door is effected. However, there is a considerable time lag before the door is opened sufficiently to allow passage of the person. Accordingly, the person may be prevented from passing the door smoothly or be frightened at the door, or sometimes the person may accidentally collide with the door.

In order to resolve such a problem described above, it is only necessary to raise the speed of the turnover operation as high as possible or to increase or widen the detection area of the human body detecting sensor. However, if the speed of the turnover operation rises, an excessive force may be applied to a door driving mechanism and knocking of the door may occur, resulting in deterioration in durability of the door and in production of noises. This is particularly remarkable with a heavy door such as a door in which reinforced glass is used because its kinetic energy is high. Therefore, there is a limitation to an increase of the speed of a turnover operation of a door.

Meanwhile, if the detection area is too wide, then even a passenger who will only pass by the door and not pass the door may be detected, and hence the door may be opened or closed in vain.

SUMMARY OF THE INVENTION

It is an object of the present invention to provide a controlling device for an automatic door which can detect a human body approaching the door assuredly in a relatively early stage.

It is another object of the invention to provide an automatic door system which assures smooth passage of a person therethrough after another person has passed the door.

According to the present invention, there is provided a controlling device for controlling opening and closing operations of an automatic door system which includes a door and a door driving mechanism, comprising a controller for controlling the door driving mechanism to open and close the door, a first human body detecting sensor having a small detecting area located near the door, and a second human body detecting sensor having a wider detecting area which extends remotely from the door and covers the detecting area of the first human body sensor, the controller being operable to develop a door opening signal in response to a human body detection signal received from the first human body detecting sensor when a door closing signal is not being developed from the controller whereas the controller develops a door opening signal in response to a human body detection signal from the second human body detecting sensor when a door closing signal is being developed from the controller.

Accordingly, when the door is being closed, an opening signal is developed at an early stage, but normally an opening signal is developed at a later stage. In particular, if the second human body detecting sensor having a wider detection area remote from the door detects a human body when the controller is developing a closing signal, that is, during closing operation of the door, an opening signal is developed in response to the human body detection signal. Accordingly, an interval of time until a person reaches the door after development of an opening signal is assured sufficiently long, and hence even if the turnover operation of the door from a closing to an opening action is slow, smooth passage of the person will not be disturbed nor will the person be frightened by the slowly turning over door, and besides the person will never collide with the door.

Accordingly, no excessive force will be applied to the door driving mechanism nor knocking of the door will occur. Therefore, the door will not be deteriorated in durability nor will produce noises, and hence is preferable as a door.

In addition, since an opening signal is not developed from the controller in response to a human body detection signal from the second human body detecting sensor when the controller is not developing a closing signal, that is, during ordinary opening and closing operations, the door will not be opened or closed in vain in response to detection of a passenger who will only pass by the door and not pass through the door.

DESCRIPTION OF THE PREFERRED EMBODIMENT

Figure 1:
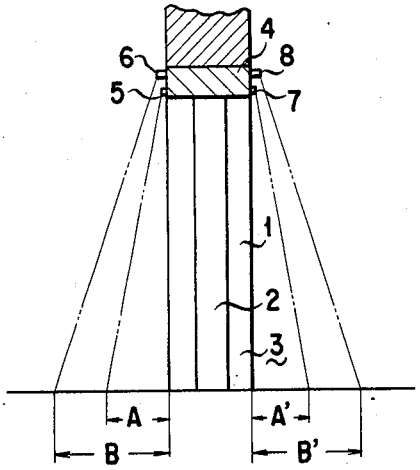
FIG. 1 is a schematic illustration of part of a door system including a controlling device according to an embodiment of the present invention.

Referring first to FIG. 1, a door 2 is mounted for opening and closing movement in a door frame 1 such that it may open and close a doorway 3. First and second one side human body detecting sensors 5 and 6 and first and second opposite side human body detecting sensors 7 and 8 are mounted on opposite sides of an upper cross member 4 of the door frame 1 inside and outside a room, respectively. Detecting areas A and A′ of the first one side and opposite side human body detecting sensors 5 and 7, respectively, are relatively small or narrow and located near the door 2 while detecting areas B and B′ of the second one side and opposite side human body detecting sensors 6 and 8, respectively, are relatively large or wide and extend remotely from the door 2 covering the detection areas A and A' of the first one side and opposite side human body detecting sensors 5 and 7, respectively.

Figure 2:
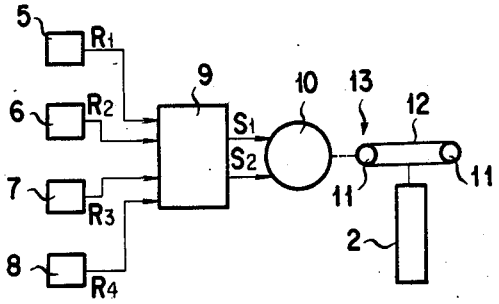
FIG. 2 is a circuit diagram of a controlling circuit of the controlling device.

If any of the human body detecting sensors 5, 6, 7 and 8 detects a human body, a human body detection signal R1, R2, R3 or R4 is developed therefrom and delivered to a controller 9 as seen from FIG. 2 so that a forward or reverse rotation signal, that is, an opening or closing signal S1 or S2 may be developed from the controller 9 to a motor 10 for opening and closing the door 2.

The motor 10 is connected to the door 2 via a door driving mechanism 13 which may include a pair of pulleys 11, a belt 12 and so on.

Figure 3:
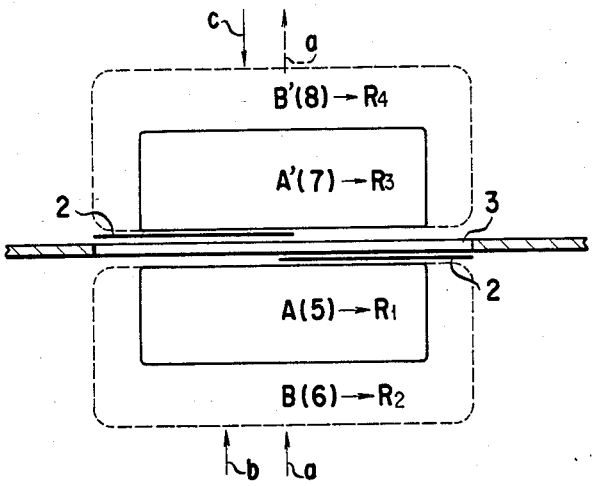
FIG. 3 is a schematic plan view illustrating operations of the door system of FIG. 1.

Operation of the controller 9 will now be described with reference to a plan view of FIG. 3 wherein the door system is illustrated having two slide doors 2.

Figure 4:
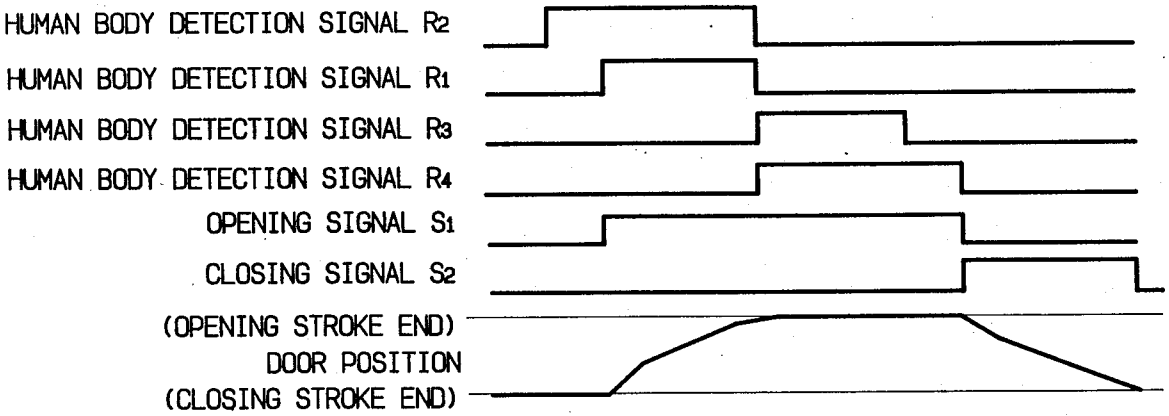
FIGS. 4, 5 and 6 are timing charts illustrating operations of the controlling device including the controlling circuit of FIG. 2.

When a person passes the door system in a direction of arrow marks a, the second one side human body detecting sensor 6 will at first develop a human body detection signal R2 as seen from FIG. 4, and then the first one side human body detecting sensor 5 will develop a human body detection signal R1. When the signal R1 is developed, an opening signal S1 is developed from the controller 9 to open the doors 2.

As the person passes the doorway 3, the first and second one side human body detecting sensors 5 and 6 will be turned off, and at the same time the first and second opposite side human body detecting sensors 7 and 8 will be turned on at a time to develop human body detection signals R3 and R4 while the opening signal S1 is being developed from the controller 9. After then, the first opposite side human body detecting sensor 7 will be turned off and then the second opposite side human body detecting sensor 8 will be turned off. Consequently, the opening signal S1 will be stopped by the action of the sensor 8 and a closing signal S2 will now be developed from the controller 9 so that the doors 2 will be closed. The closing signal S2 will be stopped at a closing stroke end.

It is to be mentioned that the doors 2 will come to an opening stroke end when human body detection signals R3 and R4 are both developed from the first and second opposite side human body detecting sensors 7 and 8 and will thereafter be held to the stroke end until a closing signal S2 is subsequently developed to close the doors 2 to the closing stroke end.

Figure 5:
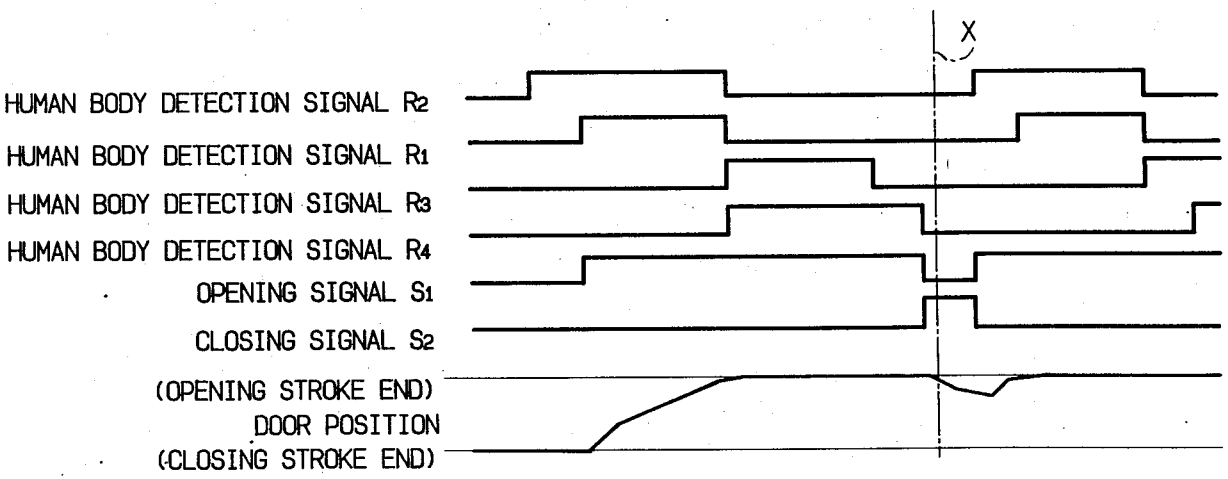

If another person comes to the doors 2 as indicated by an arrow mark b during such closing motion of the doors 2 as described above, operation of the device will be such as illustrated in FIG. 5.

In particular, operation is similar to that described above until a position as indicated by a line X in FIG. 5 is reached. If the second person approaches the doors 2 as indicated by the arrow mark b in FIG. 3 before the doors 2 come to the closing end stroke, the second one side human body detecting sensor 6 having the wider detection area B will be turned on to develop a human body detection signal R2. As the controller 9 thus receives the human body detection signal R2, it stops development of the closing signal S2 and now develops an opening signal S1 to forwardly drive the motor 10 to open the doors 2.

In this instance, since the distance between the second person and the doors 2 is sufficiently long due to the wider detection range of the second human body detecting sensors 6 and 8 and hence it takes a long time for the second person to approach the doors 2, even if the turnover operation is slow, the doors 2 will be opened sufficiently wide to allow the first person to pass the doorway 3 before the second person reaches the doors 2.

It is to be noted that operation of the system after the second person has passed the doorway 3 is similar to that described above with reference FIG. 4.

Figure 6:
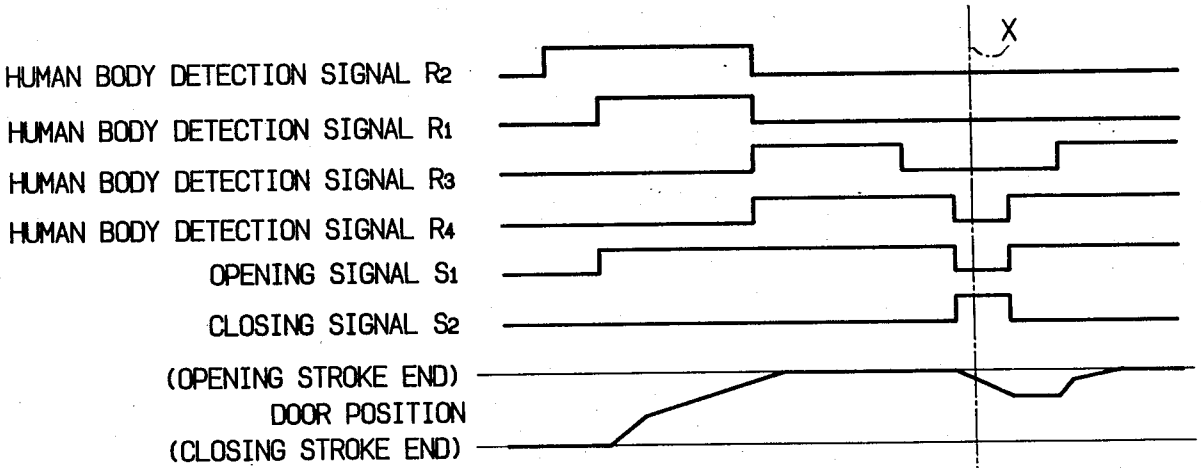

On the other hand, if another person approaches the doors 2 from the opposite side as indicated by an arrow mark c during closing operation of the doors 2, operation is similar to that described above until a position as indicated by a line X in FIG. 6 is reached. After then, the second opposite side human body detecting sensor 8 will be turned on to develop a human body detection signal R4. Accordingly, development of the closing signal S2 is stopped and an opening signal S1 is developed from the controller 9 to open the doors 2 in a similar manner to that described above.

In summary, when neither of opening and closing signals S1 and S2 is being developed from the controller 9, if a human body detection signal R1 or R3 is received from the first one side or opposite side human body detecting sensor 5 or 7, the controller 9 develops an opening signal S1. On the other hand, when a closing signal S2 is being developed from the controller 9, if a human body detection signal R2 or R4 is received from the second one side or opposite side human body detecting sensors 6 and 8, an opening signal S1 is now developed from the controller 9.

It is to be noted that an ultrared ray sensor or a mat switch may be used for the human body detecting sensor.

What is claimed is:

1. A controlling device for controlling opening and closing operations of an automatic sliding door system which includes a door and a door driving mechanism, comprising a controller for controlling said door driving mechanism to open and close said door, a pair of first human body detecting sensors located on opposite sides of said door and having a small detecting area located near said door, and a pair of second human body detecting sensors located on opposite sides of said door and having a wider detecting area which extends remotely from said door and covers the detecting area of said first human body sensor, said controller being operable to develop a door opening signal in response to a human body detection signal received from one of said first human body detecting sensors when a door closing signal is not being developed from said controller whereas said controller develops a door opening signal in response to a human body detection signal from one of said second human body detecting sensors when a door closing signal is being developed from said controller.

2. A controlling device according to claim 1, wherein said controller is operable to develop a door closing signal when one of said first human body detecting sensors located on one side of said door stops its development of a human body detection signal and then one of said second human body detecting sensors located on the one side of said door stops its development of a human body detection signal while said controller is developing a door opening signal.

* * * * *